US005648904A

United States Patent [19]

Scott

[11] Patent Number: 5,648,904

[45] Date of Patent: Jul. 15, 1997

[54] VEHICLE TRAFFIC SYSTEM AND METHOD

[75] Inventor: Ed Scott, Anaheim Hills, Calif.

[73] Assignees: Sony Corporation, Tokyo, Japan; Sony Trans Com Inc., N.J.

[21] Appl. No.: 567,857

[22] Filed: Dec. 6, 1995

Related U.S. Application Data

[63] Continuation of Ser. No. 232,712, Apr. 25, 1994, abandoned.

[51] Int. Cl.[6] ..... G08G 1/042; G06G 7/76

[52] U.S. Cl. ..... 364/436; 364/438; 340/910; 340/917; 116/62.3

[58] Field of Search ..... 364/436, 438, 364/424.02, 565; 340/917, 933, 936, 910, 941; 404/1, 9, 16; 116/62.3, 63 R, 74

[56] References Cited

U.S. PATENT DOCUMENTS

| | | | |
|---|---|---|---|
| 3,275,984 | 9/1966 | Barker | 340/31 |
| 3,544,958 | 12/1970 | Carey et al. | 340/31 |
| 3,626,413 | 12/1971 | Zachmann | 342/104 |
| 4,038,633 | 7/1977 | King | 340/941 |
| 4,251,797 | 2/1981 | Bragas et al. | 340/905 |
| 4,727,371 | 2/1988 | Wulkowicz | 340/917 |
| 4,750,129 | 6/1988 | Hengstmengel et al. | 364/436 |
| 4,790,684 | 12/1988 | Adams | 404/16 |
| 5,008,666 | 4/1991 | Gebert et al. | 340/936 |
| 5,214,793 | 5/1993 | Conway et al. | 340/905 |
| 5,231,393 | 7/1993 | Strickland | 340/936 |
| 5,281,964 | 1/1994 | Iida et al. | 340/933 |
| 5,293,163 | 3/1994 | Kakihara et al. | 364/449 |

*Primary Examiner*—Kevin J. Teska
*Assistant Examiner*—Tan Nguyen
*Attorney, Agent, or Firm*—Limbach & Limbach L.L.P.

[57] ABSTRACT

A method and system for controlling the flow of vehicle traffic. The system of the invention includes a grid of one-way streets, and a one-way ramp near each street intersection. Each ramp allows only a right-turn at an intersection. Preferably, each intersection is an overpass intersection, so that each street directs vehicles not making a right-turn at an intersection over or under the intersecting street. Preferably, the system also includes a traffic monitoring subsystem, including one or more velocity sensor stations positioned along the streets, and a processor for processing the output of each velocity sensor station to determine the average speed of vehicles translating past the velocity sensor station. Preferably, each velocity sensor station includes at least two magnetic sensors embedded in the street surface. Each magnetic sensor outputs a signal in response to proximity of a passing vehicle. An average vehicle velocity is determined from one or more sets of sensor output signals, each set generated in response to a different vehicle. Preferably, a velocity sensor station is provided downstream of each ramp, average velocity signals are generated from several velocity sensor stations positioned at consecutive identically-directed streets and are converted into form for display, and the converted signals are displayed on a display device mounted along a first street intersecting the identically-directed streets, to enable one in a vehicle translating along the first street to make an intelligent decision about which of several consecutive right turns to take.

8 Claims, 4 Drawing Sheets

VEHICLE TRAFFIC SYSTEM AND METHOD

This is a continuation of application Ser. No. 08/232,712 filed on Apr. 25, 1994, now abandoned.

FIELD OF THE INVENTION

The invention pertains to methods and systems for controlling the flow of vehicle traffic, particularly on urban streets. The invention thus pertains to the fields of environmental planning, city design, traffic flow design, and traffic flow equipment.

BACKGROUND OF THE INVENTION

Modern urban areas typically suffer from severe problems due to vehicle traffic congestion.

It would be desirable to control surface vehicle (e.g., automobiles, tracks, buses, streetcars, and the like) traffic flow to reduce average travel time, reduce the frequency of traffic accidents (and the level of associated medical and other costs), reduce pollution (and associated costs) and wasted energy consumption, and reduce the stress experienced by drivers enduring traffic jams and dangerously heavy traffic conditions.

Throughout the disclosure (including in the claims) the term "street" is employed in a broad sense to denote any road, street, highway, bridge, track, set of tracks, or tunnel, or other structure establishing a pathway for one-dimensional transportation (i.e., translation along a one-dimensional axis, which can be curved or linear).

Throughout the disclosure (including in the claims) the term "vehicle" is employed in a broad sense to denote any transportation apparatus capable of translating along a "street." Examples of a "vehicle" translating along a "street" include an automobile translating along a paved road, and a streetcar translating along a pair of parallel tracks. Preferred embodiments of the invention control the flow of automobiles, trucks, and busses as they drive along a grid of paved roads.

SUMMARY OF THE INVENTION

The invention is a method and system for controlling the flow of vehicle traffic. The system of the invention includes a grid (preferably a rectangular grid) of one-way streets, and a one-way ramp near each intersection of two of the streets. Each ramp allows only a single type of turn (preferably a right-turn) at an intersection. Each intersection is an overpass or underpass intersection, at which (assuming the surfaces of the intersecting streets are generally horizontal) one street is displaced vertically with respect to the other. For convenience, the term "overpass" intersection is used below (including in the claims) in a broad sense to denote any of an overpass intersection structure in which a first street is horizontal and the other street (which intersects the first street) rises over the first street, an underpass intersection structure in which a first street is horizontal and the intersecting street is diverted under the first street, or an overpass/underpass intersection structure in which both streets are displaced from horizontal but one passes over the other.

Preferably, the inventive system also includes a traffic monitoring subsystem. This subsystem includes a velocity sensor station (which can consist of two or more proximity sensors) mounted along each of one or more street segments between street intersections, and a means for processing the output of each velocity sensor station to determine the average speed of vehicles translating past the velocity sensor station. In preferred embodiments, each velocity sensor station includes two or more magnetic sensors embedded in (or just below) the street surface. Each magnetic sensor outputs a signal in response to proximity of a passing vehicle (e.g., a passing vehicle frame, frame portion, or other component made of steel or other magnetically permeable material). Alternatively, other vehicle proximity sensors can be used (such as mass sensors or optical shadow sensors). An average vehicle velocity can be determined from a set of output signals generated in response to a single vehicle, but preferably several sets of output signals (each set generated in response to a different vehicle) are processed to determine average vehicle velocity.

Preferably, a velocity sensor station is provided downstream of each right-turn ramp, and one or more processors generate a set of average velocity signals from several velocity sensor stations positioned at consecutive identically-directed streets. The average velocity signals are transformed into a form in which they can be displayed, and the transformed signals are displayed on a display device mounted along a first street (where the first street intersects the consecutive identically-directed streets). This enables a driver of a vehicle translating along the first street to make an intelligent decision about which of several consecutive right turns to take, based on the information displayed on the display device.

Preferably, ramped pedestrian bridges and/or tunnels are provided to eliminate the need for pedestrians to cross any street.

The system of the invention can be most easily and inexpensively implemented in cases where an entire city (or major portion of a city) is being planned and has not yet been built. For example, the system is particularly easy to implement in the context of a redevelopment project in which a large portion of a city will be demolished and replaced.

Alternative embodiments of the system implement system-wide collection of street velocity data for central broadcast to automated route planning computers located within individual vehicles. Some such systems would provide drivers with route plan maps displayed on LCD or other display panels within the drivers' vehicles to minimize the confusion of best route selection. Some embodiments would also indicate anticipated route traversal time and make any necessary mid course correction to accommodate traffic changes on-route. The addition of route planning would make the system more useful and simpler for drivers. A central collection and transmitting station would preferably broadcast to a route display panel within each vehicle. GPS navigation data could be used to indicate current vehicle position and the driver could select a destination from a list of places or by indicating the position on a displayed map. The in-vehicle map display could color-code positions of the route to indicate average speed.

DESCRIPTION OF THE PREFERRED EMBODIMENTS

Figure 1:
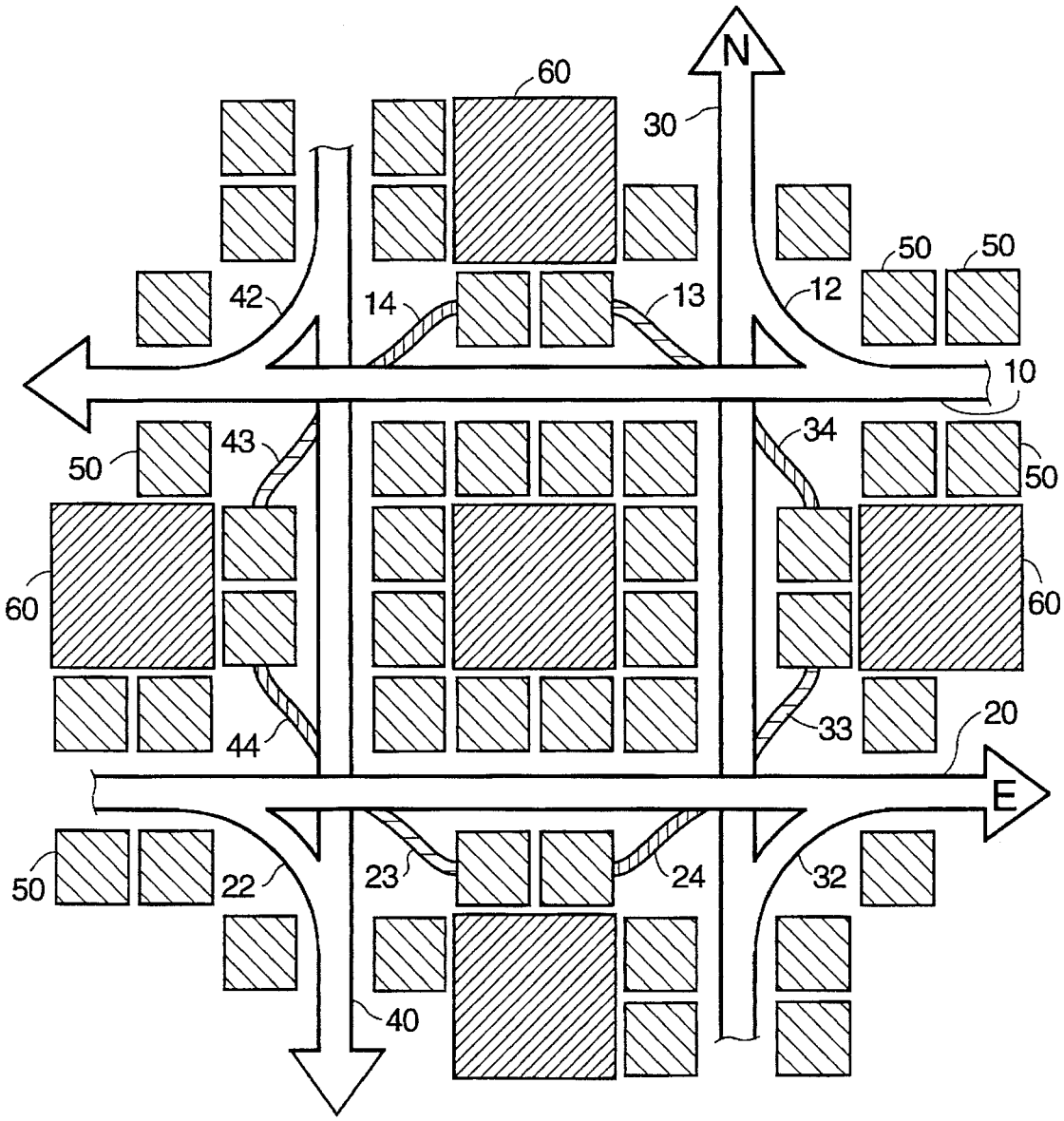
FIG. 1 is a simplified plan view of a system embodying the invention.
Figure 1:
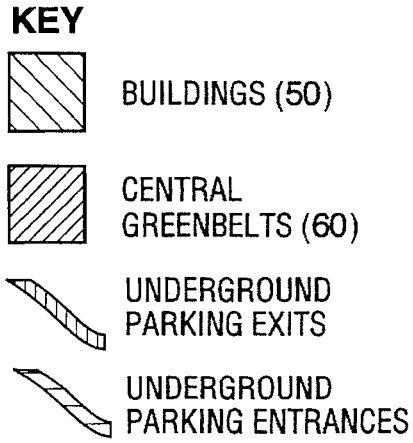

FIG. 1 is a preferred embodiment of the system of the invention. FIG. 1 shows a grid of streets including westbound one-way street 10, eastbound one-way street 20, northbound one-way street 30, and southbound one-way street 40. The intersection between streets 10 and 30 is an overpass intersection in which street 30 lies generally in the plane of FIG. 1 (a horizontal plane) and street 10 rises (out of the plane of FIG. 1) over street 30 (or in which street 10 lies generally in the plane of FIG. 1 and street 30 diverted under (into the plane of FIG. 1) street 10). Similarly, the intersection between streets 10 and 40 is an overpass intersection in which street 10 passes over (perpendicular to the plane of FIG. 1) street 40, the intersection between streets 20 and 40 is an overpass intersection in which street 20 passes over (perpendicular to the plane of FIG. 1) street 40, and the intersection between streets 20 and 30 is an overpass intersection in which street 20 passes over (perpendicular to the plane of FIG. 1) street 30. Alternatively, all of streets 10, 20, 30, and 40 are generally horizontal, and streets 10 and 20 are elevated (throughout their entire length) above streets 30 and 40 (throughout their entire length).

Ramp 12 between street 10 and street 30 provides a path for a vehicle translating on street 10 toward the west (leftward in FIG. 1) to make a right turn onto street 30. Similarly, ramp 42 between street 40 and street 10 provides a path for a vehicle translating southbound on street 40 (toward the bottom of in FIG. 1) to make a right turn onto street 10, ramp 22 between street 20 and street 40 provides a path for a vehicle translating eastbound on street 20 to make a right turn onto street 40, and ramp 32 between street 30 and street 20 provides a path for a vehicle translating northbound on street 30 to make a right turn onto street 20.

No ramp provides a path for a vehicle to make a left turn. Instead, a vehicle operator wishing to make a left turn will move the vehicle through three consecutive right turns. To make a "U-turn," the vehicle operator will move the vehicle through two consecutive right turns. It is contemplated that vehicles will be prohibited from making any left turn while translating through the system of the invention.

In an embodiment in which streets 10 and 20 are elevated (throughout their entire length) above streets 30 and 40 (throughout their entire length), each of ramps 12 and 22 is a descending ramp, and each of ramps 32 and 42 is an ascending ramp. Since on the average, 50% of turn transitions will result in energy expenditure (for climbing against the earth's gravitational field) and 50% will result in energy gain (as a result of descending in the direction of the earth's gravitational field), provision of ascending and descending ramps is expected to result in no significant energy gain or loss relative to alternative embodiments in which the ramps are substantially horizontal.

With reference again to FIG. 1, streets 10, 20, 30, and 40 typically extend through environment including buildings 50 and greenbelt areas 60. Underground vehicle parking areas (not shown in FIG. 1) can be provided under selected ones of buildings 50 and/or areas 60. Vehicles traveling northbound on street 30 can exit toward the right from street 30 and enter underground parking entrance ramp 33 (which is a one-way ramp). After parking in an underground parking lot at the end of ramp 33, vehicles can re-enter street 30 from underground parking exit ramp 34 (which is also a one-way ramp). Similarly, vehicles traveling on street 10 can exit toward the right from street 10 and enter underground parking entrance ramp 13, and after parking in an underground parking lot at the end of ramp 13, vehicles can re-enter street 10 from underground parking exit ramp 14. Each of one-way underground parking entrance ramps 23 and 43 serves the same functions as ramp 33, and each of one-way underground parking exit ramps 24 and 44 serves the same functions as ramp 34, but with respect to streets 20 and 40, respectively (rather than street 30).

Figure 2:
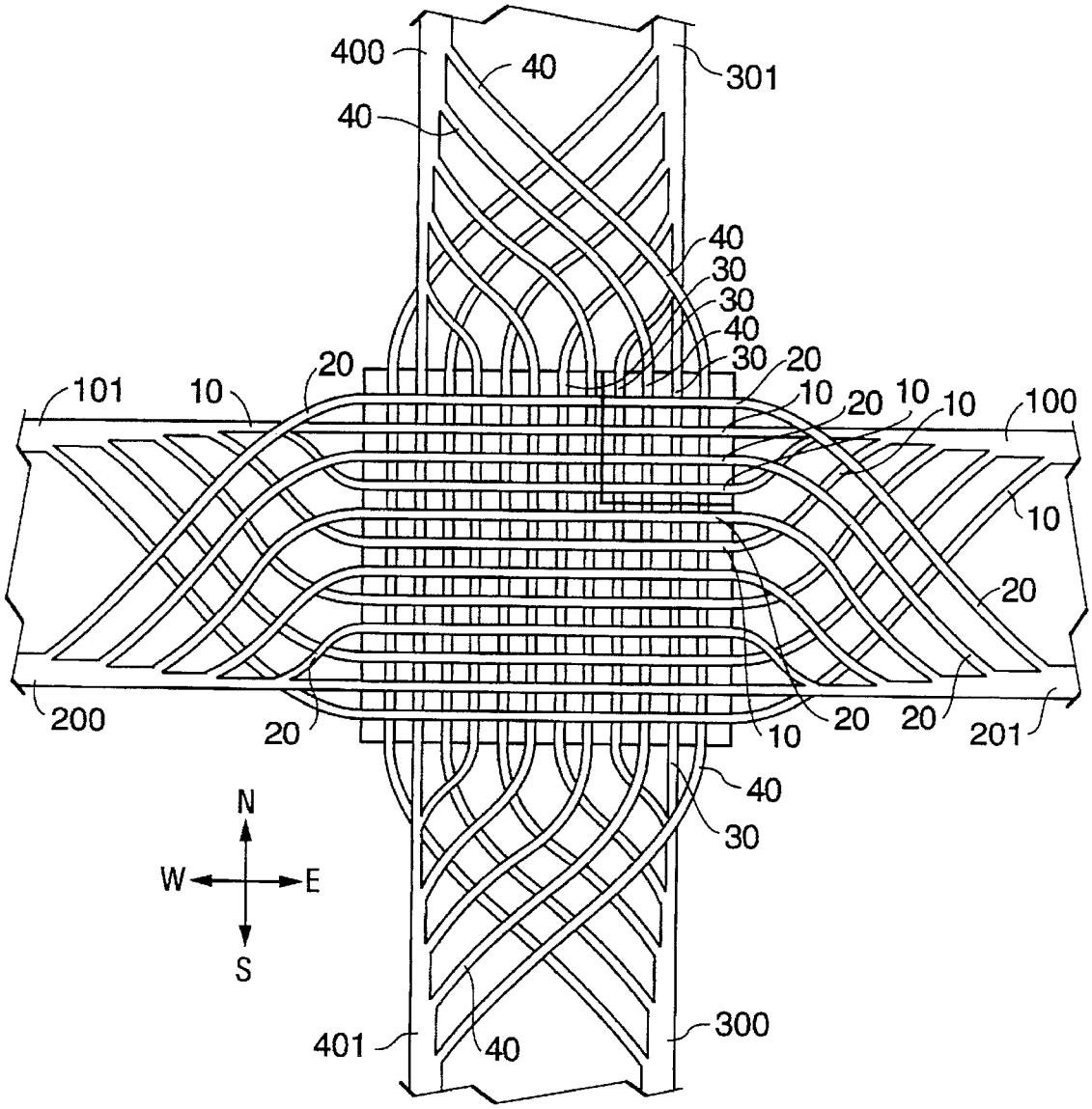
FIG. 2 is a simplified plan view of a larger system embodying the invention, where the FIG. 1 system is a subsystem of the FIG. 2 system.

FIG. 2 is a simplified plan view of a larger system embodying the invention. The FIG. 1 system is a subsystem included within the FIG. 2 system. The FIG. 2 system includes a grid of six parallel eastbound one-way streets 20, six parallel westbound one-way streets 10, six parallel southbound one-way streets 40, and six parallel northbound one-way streets 30. The grid of FIG. 2 is "rectangular" in the sense that its streets consist of a first set of generally parallel streets (10 and 20) and a second set of generally parallel streets (30 and 40), and the angle of intersection between each street in the first set and each street in the second set is a substantially a right angle.

The six streets 10 branch off sequentially from westbound street 100 (which can be a major highway or freeway), and recombine sequentially with westbound street 101 (which can also be a major highway or freeway). The six streets 20 branch off sequentially from eastbound street 200 (which can be a major highway or freeway), and recombine sequentially with eastbound street 201 (which can also be a freeway or major highway). The six streets 30 branch off sequentially from northbound street 300, and recombine sequentially with northbound street 301. The six streets 40 branch off sequentially from southbound street 400, and recombine sequentially with southbound street 401.

Each intersection in the grid of streets 10, 20, 30, and 40 of FIG. 2 is an overpass intersection of one of the types described above with reference to FIG. 1. It will be appreciated by inspecting FIG. 2 that the FIG. 1 system is a small subsystem of the grid of FIG. 2 (the FIG. 1 system includes a 2×2 grid of intersections, while the FIG. 2 system includes a 12×12 grid of intersections).

The system of the invention is modular, in the sense that a small version of it (including an M×N grid of intersections) can easily be expanded into a larger version (a version including an M'×N' grid of intersections, where N'>N or M'>M, or boM, or both N'>N and M'>M). For example, the FIG. 2 system may have been constructed in two-stages: initial construction of the subsystem in its upper right (Northeast) corner comprising a 4×4 intersection grid; and later construction of the remainder of FIG. 2 (including "highways" 100, 101, 200, 201, 300, 301, 400, and 401 and their connections with streets 10, 20, 30, and 40).

FIG. 2 is a simplified view which does not show all features of preferred embodiments of the inventive system (for example, a right-turn ramp such as ramp 12 or 42 of FIG. 1 at each intersection, entrance and exit ramps such as ramps 33 and 34 of FIG. 1, and a traffic monitoring subsystem of the type to be described with reference to FIGS. 3 and 4).

We next describe the traffic monitoring subsystem included in preferred embodiments of the invention. Such a traffic monitoring subsystem includes a velocity sensor station mounted along each of one or more street segments between street intersections, and a means for processing the output of each velocity sensor station to determine the average speed of vehicles translating past each velocity sensor station. In the embodiment shown in FIG. 4, the traffic monitoring subsystem includes several velocity sensor stations, each station consisting of two or more of proximity sensors 110, 112, 114, 210, 212, and 214, mounted along one of streets 10, 11, 20, 30, and 40 downstream from one of the street intersections (80, 81, 82, 83, 84, and 85). A processor (e.g., processor 115 or 215) processes the output of each station's sensors to determine the average speed of vehicles translating past each station. In FIG. 4, the velocity sensor station near intersection 80 includes vehicle sensors 110, 112, and 114, and processor 115 which receives and processes the output of sensors 110, 112, and 114, and the velocity sensor station near intersection 84 includes vehicle sensors 210, 212, and 214, and processor 215 which receives and processes the output of sensors 210, 212, and 214. The velocity sensor station near each of intersections 81, 82, and 85 includes three sensors (110, 112, and 114) and a processor (not shown) for processing the output of these sensors. The velocity sensor station near intersection 83 includes two sensors (110 and 112) and a processor (not shown) for processing the output of these sensors. The processor of each station in FIG. 4 is connected to the sensors of that station by wires or cables (indicated by dashed lines). In variations on the FIG. 4 system, a single processor at each station receives the output of the sensors at that station by a wireless communication link. In most cases, it will be sufficient for each velocity sensor station to include two sensors (rather than three). In other variations on the FIG. 4 system, a single processor serving two or more stations receives (and processes) the output of the sensors of all such stations, via wires or cables, or a wireless communication link.

Figure 4:
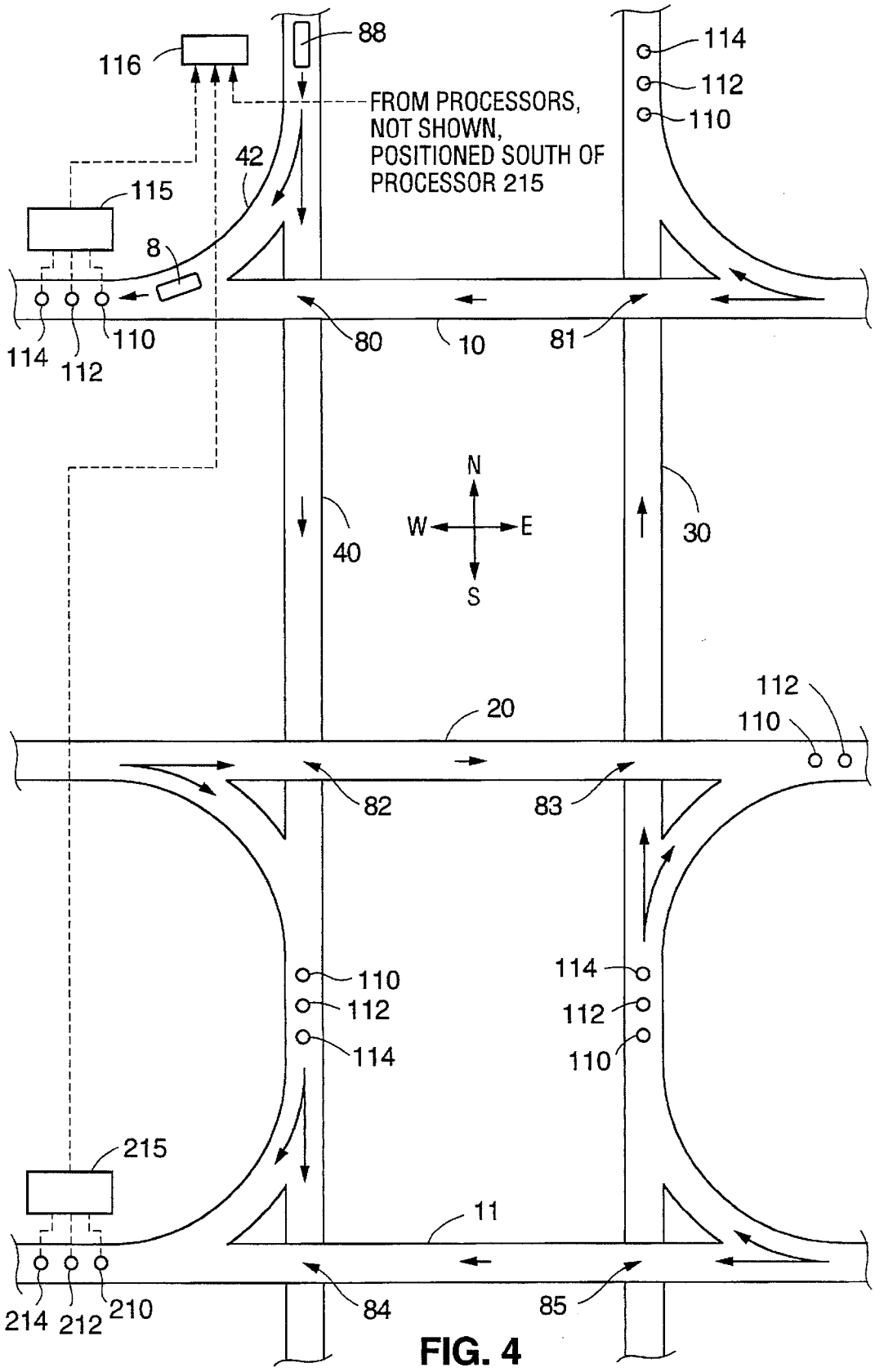
FIG. 4 is a simplified plan view of another embodiment of the system of the invention.

In FIG. 4, each of sensors 110, 112, 114, 210, 212, and 214 is preferably a magnetic sensor embedded in (or just below) the street surface. Each magnetic sensor will output a signal in response to proximity of a passing vehicle having a frame or other component made of steel or other magnetically permeable material. Such magnetically permeable material may alter the magnetic field at an active element of the sensor, generating a distinctive signal as a result. Consider the case of vehicle 8 of FIG. 4, for example, which has just made a right turn from street 40, over ramp 42, onto street 10, and is continuing toward the left on street 10. When vehicle 8 passes over sensor 110, sensor 112, and sensor 114 in sequence, the sensors will assert a sequence of three signals to processor 115. Processor 115 will process these three signals to compute the average velocity of vehicle 8 along the street segment between sensor 110 and sensor 114 (alternatively, sensor 112 can be omitted and processor 115 can compute the average velocity by processing the output of sensors 110 and 114 only).

Each processor for processing the sensor output signals of a velocity sensor station determines an average vehicle velocity from two or more sensor output signals generated in response to a single vehicle. Preferably, each processor is programmed with software for processing several sets of sensor output signals (each set generated in response to a different vehicle) to determine average vehicle velocity at a particular sensor station. Preferably, the processor is programmed to address the following case: a vehicle changes lanes between successive sensors and is detected by only one of two sensors, or one or two of three sensors. Unless addressed, such an event might throw the system out of sync. One way to address the problem would be to perform sensed magnetic field amplitude correlation. Over time it would then be possible to re-synchronize the system and correct for the undesired condition resulting from such a vehicle lane change. Another correction would be to include an inter gap lane change sensor between the velocity sensors in different lanes, and process the signals output from such additional sensor. Locating sensors closer together would help minimize the lane change—resynchronization problem. Processor 115 preferably computes speed=distance/time, where "distance" is the separation between sensors, and "time" is the period between the end of the earlier sensor pulse and the beginning of the later sensor pulse.

Preferably, there is a velocity sensor station downstream of each right-turn ramp (as in FIG. 4), and average velocity signals from several velocity sensor stations positioned at consecutive identically-directed streets are generated (either in separate processors such as processors 115 and 215 in FIG. 4, or in one common processor which receives raw sensor signals from all the stations). The average velocity signals are transformed into a form in which they can be displayed, and the transformed signals are displayed on a display device (such as display device 116) mounted along a first street (where the first street intersects the consecutive identically-directed streets). This enables a driver of a vehicle translating along the first street to make an intelligent decision about which of several consecutive right turns to take, based on the information displayed on the display device.

Figure 3:
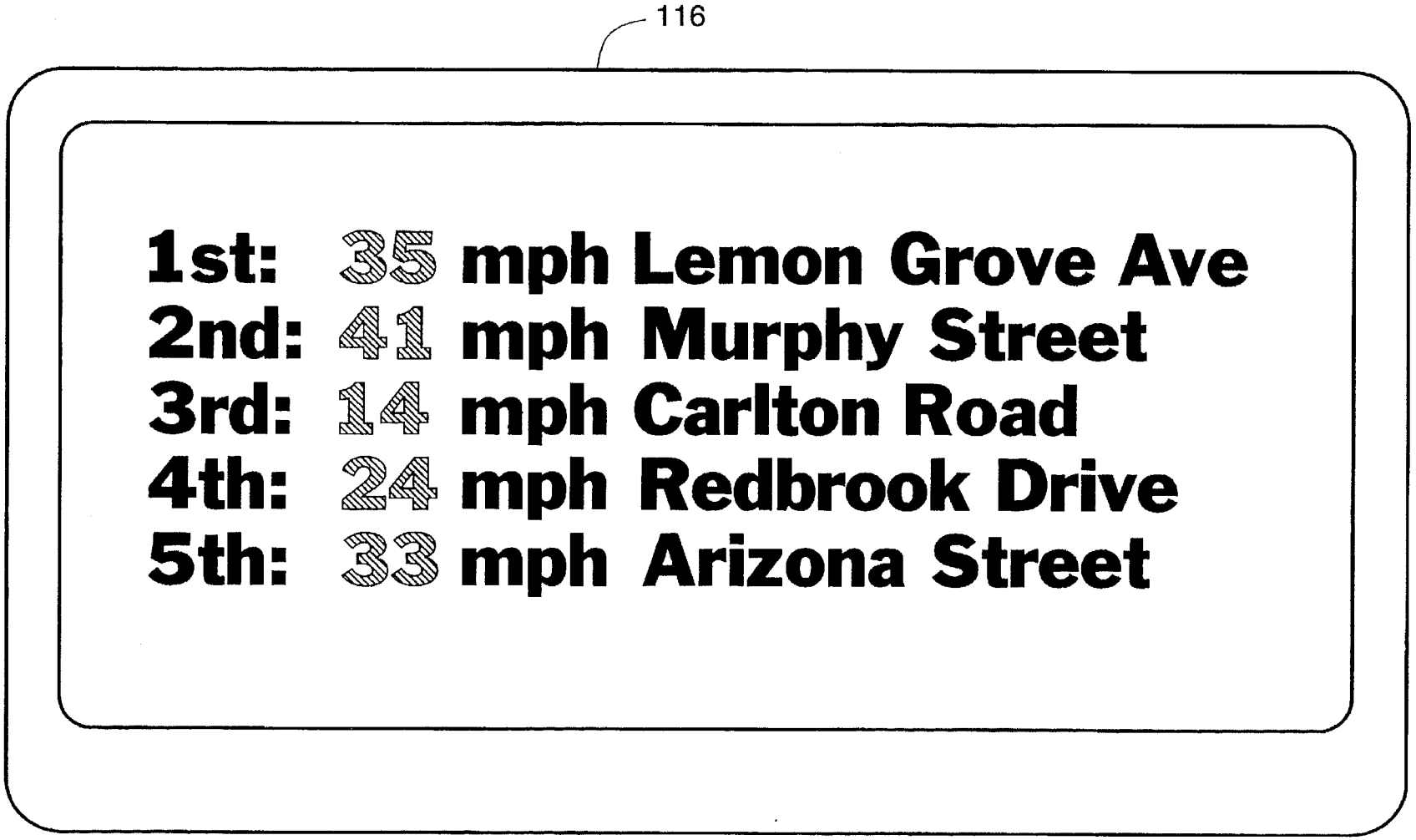
FIG. 3 is a front elevational view of a display generated in accordance with a preferred embodiment of the invention.

For example, display device 116 can generate the display shown in FIG. 3. The uppermost line of the FIG. 3 display ("1st: 35 mph Lemon Grove Ave") is a display of an output signal from processor 115 which is indicative of the average velocity of vehicles traveling westbound along street 10 over sensors 110, 112, and 114. The second line of the FIG. 3 display ("2nd: 41 mph Murphy Street") is a display of an output signal from processor 215 which is indicative of the average velocity of vehicles traveling westbound along street 11 over sensors 210, 212, and 214. The three lowest lines of the FIG. 3 display are displays of output signals from processors (not shown in FIG. 4) at three velocity sensor stations positioned south of processor 215 (each along a west-bound street south of street 11), each of which is indicative of the average velocity of vehicles traveling westbound along one of the streets south of street 11. By inspecting the FIG. 3 display, the driver of southbound vehicle 88 on street 40 can make a decision as to which of the next five consecutive right turns to take.

Preferably, ramped pedestrian bridges (over streets of the inventive grid of streets) and/or tunnels (under streets of the inventive grid of streets) are provided to eliminate the need for pedestrians to cross any street in the system of the invention.

One class of embodiments of the inventive method includes the steps of:

establishing a grid of one-way streets, with an overpass intersection structure at each junction of two of the streets and a one-way ramp near each overpass intersection structure (each ramp providing a path for a vehicle to make a right turn from one to another of the intersecting streets); and monitoring translation of one or more vehicles along at least one of the streets, and generating a velocity signal indicative of the average speed of the monitored vehicles.

In the case that the grid includes a number of identically-directed streets (e.g., streets 10 of FIG. 2, which are all "identically-directed" toward the west in the sense that vehicles travel only toward the west on each street 10) and a set of consecutive intersections of a first street with the identically-directed streets, the method of the invention preferably includes the steps of monitoring vehicle translation at a position downstream of each of at least two of the consecutive intersections and generating average velocity signals for at least two of the identically-directed streets. The invention preferably also includes the steps of converting these average velocity signals into a form in which they can be displayed, and displaying the converted signals on a display device mounted along the first street. By viewing this display, a person in a vehicle translating along the first street can make an informed decision about which of several consecutive right turns to take onto the identically-directed streets (based on the displayed information).

In some embodiments, the invention is a traffic flow control system wherein the decision making for route selection occurs within each individual vehicle (either by the driver or by an automated route selection computer) so that the intelligence for route selection in the system operates as a large parallel processing system or a self correcting neural network. Spreading the decision making throughout the system is one of the features which would make the invention especially successful. The unidirectional traffic flow minimizes accidents and other flow blockages, and the self correcting nature of individual vehicle decision making tends to equalize flow across the system, ensuring a larger average speed for the majority of vehicles.

Various modifications and alterations in the structure and operation of this invention will be apparent to those skilled in the art without departing from the scope and spirit of this invention. For example, a variation permitting left turns only could be implemented. Although the invention has been described in connection with specific preferred embodiments, it should be understood that the invention as claimed should not be unduly limited to such specific embodiments.

What is claimed is:

1. A vehicle traffic system comprising:

a plurality of intersecting one-way streets which form a grid, each intersection of the one-way streets being in the form of an overpass; and a plurality of one-way ramps, each ramp providing a path for a vehicle moving along one of the one-way streets to make a single type of turn onto another one of the one-way streets forming an overpass intersection with the one of the one-way streets, each ramp providing a path for the same type of turn as provided by all of the other ramps;

a traffic monitoring subsystem, wherein the traffic monitoring subsystem includes:

a first velocity sensor station mounted along a first one of the one-way streets, first processing means for processing output signals from the velocity sensor station to generate a first velocity signal indicative of an average speed of at least one vehicle translating past the velocity sensor station;

a second velocity sensor station mounted along a second one of the one-way streets, where the second one of the one-way streets does not intersect the first one of the one-way streets;

second processing means for processing output signals from the second velocity sensor station to generate a second velocity signal indicative of an average speed of at least one vehicle moving past the second velocity sensor station, wherein the first processing means is programmed for generating a first display signal for controlling display of a representation of the first velocity signal, and the second processing means is programmed for generating a second display signal for controlling display of a representation of the second velocity signal; and a display device for receiving the first display signal and the second display signal, and displaying in response the representation of the first velocity signal and the representation of the second velocity signal.

2. A vehicle traffic system comprising:

a plurality of intersecting one-way streets which form a grid, each intersection of the one-way streets being in the form of an overpass; and a plurality of one-way ramps, each ramp providing a path for a vehicle moving along one of the one-way streets to make a single type of turn onto another one of the one-way streets forming an overpass intersection with the one of the one-way streets;

a traffic monitoring subsystem, wherein the traffic monitoring subsystem includes:

a velocity sensor station mounted along a first one of the one-way streets, first processing means for processing output signals from the velocity sensor station to generate a first velocity signal indicative of an average speed of at least one vehicle translating past the velocity sensor station, the first processing means programmed for generating a first display signal for controlling display of a representation of the first velocity signal, a second velocity sensor station mounted along a second one of the one-way streets, where the second one of the one-way streets does not intersect the first one of the one-way streets, and a second processing means for processing output signals from the second velocity sensor station to generate a second velocity signal indicative of an average speed of at least one vehicle moving past the second velocity sensor station, the second processing means programmed for generating a second display signal for controlling display of a representation of the second velocity signal, a display device for receiving the first display signal and the second display signal and displaying in response the representation of the first velocity signal and the representation of the second velocity signal, the display device positioned along a third one of the one-way streets, where the third one of the one-way streets intersects both the first one of the one-way streets and the second one of the one-way streets, and wherein the first one of the one-way streets and the second one of the one-way streets are identically-directed one-way streets.

3. A vehicle traffic system comprising:

a plurality of intersecting one-way streets which form a grid, each intersection of the one-way streets being in the form of an overpass; and a plurality of one-way ramps, each ramp providing a path for a vehicle moving along one of the one-way streets to make a single type of turn onto another one of the one-way streets forming an overpass intersection with the one of the one-way streets;

a traffic monitoring subsystem, wherein the traffic monitoring subsystem includes:

a first velocity sensor station mounted along a first one of the one-way streets, first processing means for processing output signals from the velocity sensor station to generate a first velocity signal indicative of an average speed of at least one vehicle translating past the velocity sensor station, the first processing means programmed for generating a first display signal for controlling display of a representation of the first velocity signal, a second velocity sensor station mounted along a second one of the one-way streets, where the second one of the one-way streets does not intersect the first one of the one-way streets, second processing means for processing output signals from the second velocity sensor station to generate a second velocity signal indicative of an average speed of at least one vehicle moving past the second velocity sensor station, the second processing means programmed for generating a second display signal for controlling display of a representation of the second velocity signal; and a display device for receiving the first display signal and the second display signal, and displaying in response the representation of the first velocity signal and the representation of the second velocity signal, the display device positioned along a third one of the one-way streets, where the third one of the one-way streets intersects both the first one of the one-way streets and the second one of the one-way streets, and wherein the first one of the one-way streets and the second one of the one-way streets are identically-directed one-way streets.

4. A vehicle traffic system comprising:

a plurality of intersecting one-way streets which form a grid, each intersection of the one-way streets being in the form of an overpass;

a plurality of one-way ramps, each ramp providing a path for a vehicle moving along one of the one-way streets to make a single type of turn onto another one of the one-way streets forming an overpass intersection with the one of the one-way streets, each ramp providing a path for the same type of turn as provided by all of the other ramps; and a traffic monitoring subsystem which includes:

a velocity sensor station mounted along a first one of the one-way streets, first processing means for processing output signals from the velocity sensor station to generate a first velocity signal indicative of an average speed of at least one vehicle translating past the velocity sensor station, a second velocity sensor station mounted along a second one of the one-way streets, where the second one of the one-way streets does not intersect the first one of the one-way streets, a second processing means for processing output signals from the second velocity sensor station to generate a second velocity signal indicative of an average speed of at least one vehicle moving past the second velocity sensor station; and wherein the first processing means is programmed for generating a first display signal for controlling display of a representation of the first velocity signal, and the second processing means is programmed for generating a second display signal for controlling display of a representation of the second velocity signal.

5. The system of claim 4, wherein the traffic monitoring subsystem also includes:

a display device for receiving the first display signal and the second display signal and displaying in response the representation of the first velocity signal and the representation of the second velocity signal.

6. A method for directing vehicle traffic, including the steps of:

forming a plurality of intersecting one-way streets into a grid, wherein the intersections of the one-way streets are in the form of overpasses, and further establishing a plurality of one-way ramps positioned so that each one-way ramp provides a path for a vehicle to make a single type of turn from one to another of the intersecting one-way streets forming an overpass intersection, each ramp providing a path for the same type of turn as provided by all of the other ramps a first plurality of one-way streets being identically-directed and forming a set of consecutive overpass intersections with a first one of a second plurality of one-way streets;

monitoring movement of vehicles at a set of locations along at least one of the one-way streets, where each of the locations is downstream from a different one of the set of consecutive overpass intersections, and generating velocity signals indicative of the average speed of the monitored vehicles for at least two of the first plurality of identically-directed one-way streets; and communicating information to drivers of the vehicles based on the velocity signal.

7. The method of claim 6, also including the steps of:

converting the average velocity signals into display signals which can be displayed; and displaying the display signals on a display device mounted along the first one of the streets second plurality of one-way.

8. The method of claim 6, wherein the step of generating average velocity signals includes generating average velocity signals for each of the first plurality of one-way streets and further includes generating average velocity signals for each of the second plurality of one-way streets, and wherein the method also including the steps of:

converting the average velocity signals generated for the first and the second plurality of one-way streets to average speed data;

gathering average speed data for the entire grid at at least one central station; and broadcasting the average speed data from the at least one central station to individual ones of the vehicles to enable an automated route computer within each of the vehicles to determine a best route display and an estimated time of arrival to a previously specified destination.

* * * * *